US005616893A

United States Patent [19]

Woods

[11] Patent Number: 5,616,893

[45] Date of Patent: Apr. 1, 1997

[54] REVERSE ENTRY MUFFLER WITH SURGE SUPPRESSION FEATURE

[76] Inventor: Woodrow E. Woods, 3640 Fiscal Ct., Riviera Beach, Fla. 33404

[21] Appl. No.: 472,334

[22] Filed: Jun. 7, 1995

[51] Int. Cl.[6] ..... F01N 7/12

[52] U.S. Cl. ..... 181/235; 181/255; 181/265

[58] Field of Search ..... 181/227, 228, 181/229, 230, 233, 235, 255, 265, 282, 260, 269; 440/89

[56] References Cited

U.S. PATENT DOCUMENTS

| | | | |
|---|---|---|---|
| 900,576 | 10/1908 | Nelson et al. | 181/235 |
| 1,065,707 | 6/1913 | Montgomery | 181/235 |
| 2,074,932 | 3/1937 | Mittendorf et al. | 181/229 |
| 3,296,997 | 1/1967 | Holby et al. | 181/235 |
| 4,184,566 | 1/1980 | Baker et al. | 181/269 X |
| 4,858,722 | 8/1989 | Abbe et al. | 181/265 X |
| 4,952,182 | 8/1990 | Curtis et al. | 440/89 |

*Primary Examiner*—Khanh Dang

*Attorney, Agent, or Firm*—Malin, Haley, DiMaggio & Crosby, P.A.

[57] ABSTRACT

An improved muffler for silencing the exhaust emitted from a marine engine employing a reverse entry inlet conduit, an attenuation chamber and an outlet conduit whereby exhaust gas and liquid is communicated through the inlet conduit and into the attenuation chamber against the direction of the outlet stream. Upon entering the attenuation chamber exhaust gases and liquids reflect off the inner walls of the chamber and incoming exhaust thereby attenuating exhaust noise until they are finally forced out of the attenuation chamber through the outlet conduit. The reverse entry design of the muffler provides protection against backwardly flowing water that commonly enters a marine exhaust system by orienting the direction of inlet flow at an angle which is greater than 0 degrees but less than 90 degrees relative to the direction of output flow from the muffler.

7 Claims, 1 Drawing Sheet

REVERSE ENTRY MUFFLER WITH SURGE SUPPRESSION FEATURE

BACKGROUND OF THE INVENTION

1. Field of the Invention

This invention relates generally to a muffler for quieting the exhaust from an internal combustion marine engine, and more particularly, to a muffler whose inlet is opposed to the direction of backflowing surge water.

2. Description of the Prior Art

The exhaust of the typical inboard marine vessel is directed through the transom. Such applications place the exhaust outlet near or below the water line leading to possible back flow situations when the exhaust gas does not present enough force to overcome a water surge, or where water enters the exhaust pipe while the engine is off. To prevent this back flow of water into the muffler or engine, a check valve or flapper valve is usually employed. Additionally, as shown in FIG. 1, in a typical prior art exhaust system a surge pipe may be employed such that the engine output is elevated with respect to the exhaust outlet thereby decreasing the possibility of back flow entering the marine engine. However, none of the prior art muffler designs have an attenuation chamber with an inlet that is opposed to the direction of backflowing surge water. Rather, the present state of the art flapper valves, having moving parts which quickly corrode and fail, leading to either a potentially dangerous blockage of exhaust flow or an open ended exhaust pipe that makes a marine engine more susceptible to backflowing surge water.

There are a variety of marine mufflers presently known in the art which are of the "axial flow" type such as the muffler disclosed in U.S. Pat. No. 4,167,987, issued to Turner. The Turner patent describes a multiple flow marine muffler wherein exhaust noise is attenuated by passing the exhaust gas through a series of longitudinally spaced opposing baffles. However, such a configuration requires an elongated cylindrical shell to provide the required baffling effect, thus precluding application in tight-fit areas such as smaller boats or other situations where space is at a premium. Additionally, the use of an axial flow muffler cannot be placed below the water line without some form of surge suppression.

Another marine muffler, known as a "lift muffler," is disclosed in U.S. Pat. No. 3,296,997, issued to Hoiby, et al. The Hoiby muffler is essentially an up-right drum-shaped housing having an exhaust inlet near the top and a stand pipe exhaust outlet centrally located with its opening spaced above the drum bottom. The stand pipe directs the muffled exhaust gas and collected cooling water upwardly and outwardly to a location where it can be discharged from the boat without further back pressure. However, Hoiby does not present a means to prevent a reverse flow of water when the exhaust outlet is submerged. Additionally, such a device precludes application in tight-fit areas as the centrally located stand pipe requires exhaust conduit modifications to accommodate the pipe.

The exhaust outlet of an inboard-powered marine vessel is usually placed at or about the water line of the boat. As a result, surges of water routinely enter the exhaust outlet and travel through the exhaust system. This surge water could disable the engine if it is permitted to travel far enough, possibly leading to disastrous results, especially if the vessel is far from port. No one has heretofore proposed a reverse entry anti-surge marine muffler in which exhaust flow and collected coolant enters the muffler against the direction of flow of the outlet stream.

Therefore, there exists a need for a muffler capable of replacing a conventional muffler and surge pipe wherein the exhaust inlet is angled such that exhaust flow enters the muffler against the direction of flow of the outlet stream and hence inhibits back flow into a marine engine without the addition of moving parts such as a check or flapper valve.

SUMMARY OF THE INVENTION

The present invention provides a reverse entry muffler for use with internal combustion marine engines. The muffler is characterized by a reverse flow geometry in which exhaust gases and fluid enter the muffler against the flow of the outlet stream. The apparatus is generally characterized by an inlet, an attenuation chamber, and an outlet which when employed in a conventional marine exhaust system inhibits potentially dangerous back flow of water into the engine without the need for any additional parts.

The attenuation chamber is centrally located between the inlet and outlet conduits. The inlet is connected to the attenuation chamber from the top side at an angle between 0 and 90 degrees with respect to the horizontal and against the direction of outlet exhaust flow and the outlet is connected such that it is not directly in line with the inlet. This insures that gases or liquids cannot pass directly through the attenuation chamber without reflecting off at least one side wall of the chamber. Moreover, this insures that backflowing surges cannot pass directly through the attenuation chamber into the inlet and ultimately into the engine. Rather, the backflow surge vector is always directed at least 90 degrees away from the centerline of the inlet conduit. Furthermore, the backflow surge enters the attenuation chamber below the connection between the inlet conduit and attenuation chamber. Accordingly, it is very difficult, if not impossible for backflowing surges to travel into the attenuation chamber, change direction by more than 90 degrees and then flow against gravity along an extended path to reach the engine.

In accordance with the present invention, it is an object to provide an improved muffler for use with marine engines which has superior anti-surge characteristics.

It is an additional object of the present invention to provide a marine muffler having an exhaust inlet which is opposed to the direction of flow of the outlet stream.

It is yet another object of the instant invention to provide an elbow-type muffler for use in tight quarters.

In accordance with these and other objects which will become apparent hereinafter, the instant invention will now be described with particular reference to the accompanying drawings.

DESCRIPTION OF THE PREFERRED EMBODIMENTS

Figure 2:
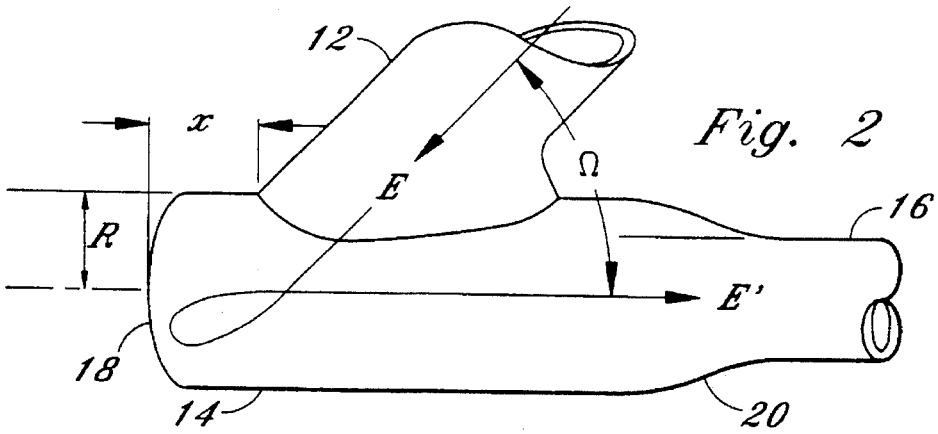
FIG. 2 is a side elevational view of the present invention.
Figure 3:
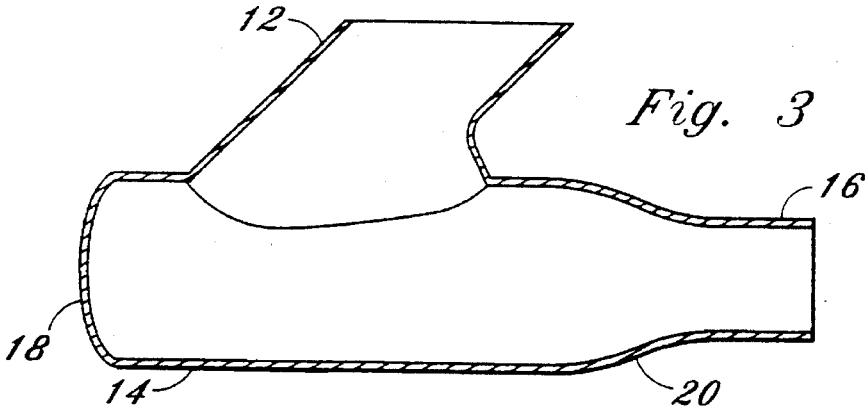
FIG. 3 is a sectional elevational view of the present invention.
Figure 4:
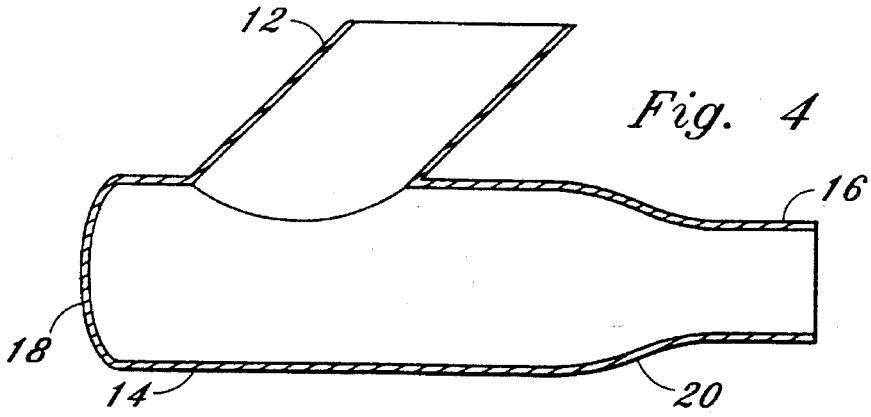
FIG. 4 is a sectional elevational view of an alternate embodiment of the present invention.

With reference to FIGS. 2–4, there is depicted a reverse entry muffler 10 comprising an inlet 12, attenuation chamber 14 and an outlet 16. Muffler 10 may be fabricated from, for example but not by way of limitation, steel or fire retardant fiberglass.

The attenuation chamber 14 preferably has a larger diameter than does inlet 12 or outlet 16. The larger diameter increases the inner surface area of the attenuation chamber and thus the volume for reflection of exhaust which in turn aids attenuation of exhaust noise emitted from the muffler.

In order to achieve the superior anti-surge characteristics of this muffler, inlet 12 is attached to attenuation chamber 14 generally parallel to a line which is such that the exhaust flow E enters chamber 14 substantially against the direction of outlet stream E'. As shown in FIG. 2, angle Ω defines the angle between the centerline of the inlet and the centerline of the outlet. In order to insure that reverse surges are restricted from entering the engine, angle Ω should be greater than 0 degrees but less than 90 degrees. In other words, the direction of incoming exhaust E is offset from the direction of outflowing exhaust E' by less than 90° but more than 0°. Essentially, the elevation angle Ω between the centerline of the outlet 16 and the central axis of the inlet 12 is restricted to the first quadrant. Where angles are specified in this specification, counterclockwise is defined as the positive rotational direction.

In the preferred embodiment, the inlet 12, attenuation chamber 14 and outlet 16 may all be cylindrical, rectangular or otherwise in shape and the back wall 18 of attenuation chamber 14 may be rounded. Additionally, the distance between the back wall 18 of the attenuation chamber and the outer wall of the inlet conduit should be equal to one-half the diameter of attenuation chamber 14, although this is not essential for the invention to achieve the desired result. As shown in FIG. 2, the distance between the inlet 12 and back wall 18 (shown as X) is equal to the radius R of the attenuation chamber 14.

As shown in FIGS. 2 and 3, inlet 12 may be flared near the point of connection to the attenuation chamber such that the inlet is wider at its connection point than it is throughout its remaining length. In this embodiment, the wider inlet aides in the expansion of exhaust gases and further assists attenuation of exhaust noise. Preferably, the inlet is connected to the attenuation chamber at a point along the top side of the chamber that produces the desired noise attenuation factor. The degree of noise attenuation is dependant, in part, upon the angle between the inlet conduit and the attenuation chamber and the distance the inlet conduit is mounted from the back wall 18 of chamber 14.

In operation, attenuation chamber 14 acts as an expansion and reflection volume in which gases entering from inlet 12 can expand and reflect off the walls of chamber 14 and ultimately dissipate acoustical energy before exiting therefrom through outlet 16. The tapered passageway 20 is adapted to make the transition between the relatively wide attenuation chamber 14 and the outlet 16 such that muffler 10 is easily connectable to a standard sized exhaust pipe (not shown) by U-bolts and the like.

Figure 1:
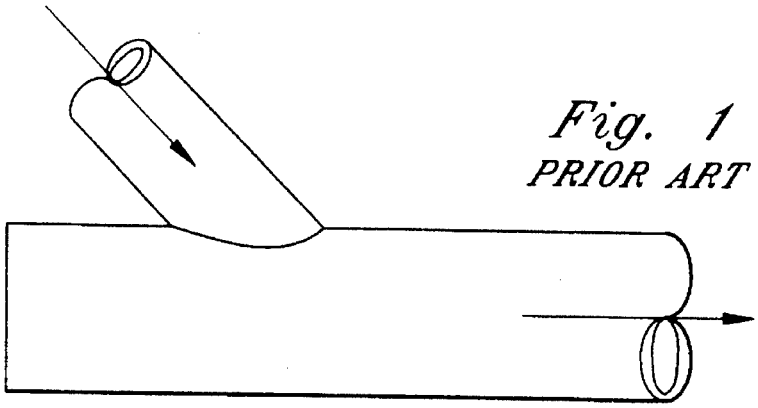
Fig. 1 PRIOR ART
FIG. 1 is a side view of a typical prior art marine muffler.

The reverse flow geometry also defines the anti-surge characteristics of the present invention. In prior art designs, as shown in FIG. 1, a reverse flowing surge enters the muffler against the direction of the arrows when the exhaust system tail pipe is below the waterline or when a wave impacts with the transom. However, without the aid of a check or flapper valve on the tailpipe this surge, if strong enough, can travel through the inlet and into the engine causing catastrophic results. On the other hand, the reverse geometry of the present invention inhibits reverse flowing surge. Specifically, in order for a reverse surge to enter the engine, it must enter the tailpipe, collide with the rear wall 18 and change direction by more than 90° and then flow against gravity through the inlet 12. Accordingly, it is very difficult if not impossible for-reverse surges to enter the engine. At the same time, the muffler is compact and, accordingly, is particularly well adapted for use in the tight quarters of a typical marine vessel.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A reverse entry muffler for silencing the exhaust output of an inboard marine engine, comprising:

an inlet having an exhaust entry end and an exhaust exit end, said inlet defining a first elongate central axis;

an elongate housing connected to said exhaust exit end of said inlet, said housing defining an attenuation chamber; said housing fluidly coupled to said inlet; and an outlet having an exhaust entry end and an exhaust exit end, said outlet fluidly coupled to said elongate housing, said elongate housing connected to said exhaust entry end of said outlet, said outlet defining a second elongate central axis; said first elongate central axis and said second elongate central axis defining an angle which is less than 90 degrees and greater than 0 degrees measured between said exhaust entry end of said inlet and said exhaust exit end of said outlet.

2. The reverse entry muffler as set forth in claim 1 wherein said inlet is flared from said first central axis proximal to said housing at said exhaust exit end of said inlet.

3. The reverse entry muffler as set forth in claim 1 wherein said attenuation chamber is cylindrical and defines an inner cylindrical surface having an inner radius and a back wall.

4. The reverse entry muffler as set forth in claim 3 wherein said attenuation chamber is tapered proximal to said outlet.

5. The reverse entry muffler as set forth in claim 3 wherein said back wall and said exhaust exit end of said inlet are spaced apart by a distance equal to said inner radius.

6. The reverse entry muffler as set forth in claim 1 wherein said inlet is fluidly coupled to said attenuation chamber above said second elongate axis.

7. A reverse entry muffler for silencing the exhaust output of an inboard marine engine, comprising:

an inlet having an exhaust entry end and an exhaust exit end, said inlet defining a first direction of exhaust gas flow from said exhaust entry end to said exhaust exit end of said inlet;

an elongate housing connected to said exhaust exit end of said inlet, said housing defining an attenuation chamber, said housing fluidly coupled to said inlet; and an outlet having an exhaust entry end and an exhaust exit end, said outlet fluidly coupled to said housing, said outlet defining a second direction of exhaust gas flow from said exhaust entry end to said exhaust exit end of said outlet, said elongate housing connected to said exhaust entry end of said outlet, said first direction of exhaust gas flow being oriented at an angle less than 90° and greater than 0° relative to said second direction of exhaust gas flow.

* * * * *